US008500145B2

(12) United States Patent
Chen

(10) Patent No.: US 8,500,145 B2
(45) Date of Patent: Aug. 6, 2013

(54) SKATEBOARD

(75) Inventor: Wang-Chuan Chen, Taichung (TW)

(73) Assignee: Chin Chen-Huang, Taichung (TW)

( * ) Notice: Subject to any disclaimer, the term of this patent is extended or adjusted under 35 U.S.C. 154(b) by 298 days.

(21) Appl. No.: 13/012,864

(22) Filed: Jan. 25, 2011

(65) Prior Publication Data

US 2012/0187648 A1 Jul. 26, 2012

(51) Int. Cl.
*B62M 1/00* (2010.01)

(52) U.S. Cl.
USPC ..... 280/87.042

(58) Field of Classification Search
USPC ..... 280/87.042, 87.021, 87.03, 87.05, 280/87.041, 842, 87.01
See application file for complete search history.

(56) References Cited

U.S. PATENT DOCUMENTS 4,861,054 A * 8/1989 Spital ..... 280/221
4,955,626 A * 9/1990 Smith et al. ..... 280/87.042
5,458,351 A * 10/1995 Yu ..... 280/87.042
6,338,494 B1 * 1/2002 Killian ..... 280/87.042
7,083,178 B2 * 8/2006 Potter ..... 280/87.042
7,195,259 B2 * 3/2007 Gang ..... 280/87.042
7,766,351 B2 8/2010 Chen et al. ..... 280/87.042
7,775,534 B2 * 8/2010 Chen et al. ..... 280/87.042
8,118,319 B2 * 2/2012 Hsieh ..... 280/87.042
8,157,274 B2 * 4/2012 Chen ..... 280/87.041
2007/0001414 A1 * 1/2007 Kang ..... 280/87.041
2008/0157495 A1 * 7/2008 Choi ..... 280/87.042
2009/0045598 A1 * 2/2009 Lee ..... 280/87.042

* cited by examiner

*Primary Examiner* — J. Allen Shriver, II
*Assistant Examiner* — James M Dolak
(74) *Attorney, Agent, or Firm* — Alan Kamrath; Kamrath IP Lawfirm, P.A.

(57) ABSTRACT

A skateboard includes a frame and a pedal. The frame has two opposing ends including a first end and a second end. The frame further has a connecting portion formed between and connected to the first end and the second end. The first end includes at least one guiding portion formed on one side thereof. The pedal is installed to the first end of the frame and includes a coupling portion. The pedal has at least one retaining portion formed on one lateral side of the coupling portion and corresponding to the guiding portion. The retaining portion is slidably disposed to the guiding portion. The frame and the first pedal are separately manufactured.

13 Claims, 11 Drawing Sheets

SKATEBOARD

BACKGROUND OF THE INVENTION

1. Field of the Invention

The present invention relates generally to a skateboard and, more particularly, to a skateboard which is assembled with a frame and two pedals, in which one end of the skateboard may be twisted or rotated with respect to another end by a user.

2. Description of the Related Art

U.S. Pat. No. 7,766,351 shows a flexible skateboard which includes a pair of direction casters mounted for steering rotation on a twistable one piece skateboard. A center section is made sufficiently narrower than outboard foot support areas so that the board may be twisted by a rider to add energy for rolling motion to wheels in the casters. The center section is made sufficiently resistant to bowing and twist so that the skateboard may be ridden as a conventional, non-flexible skateboard.

The conventional twistable one piece skateboard is fabricated from a one piece, molded plastic platform. Therefore, a large mold is needed while the plastic platform is manufactured by an injection molding process. Further, the conventional twistable one piece skateboard has a fixed size since the plastic platform is of one piece. Hence, it needs to design several molds with different sizes for different sizes of the plastic platform, and it entails substantially high manufacture costs.

While in operation, a user may cause, maintain or increase locomotion of the conventional twistable one piece skateboard by causing front and rear areas to be twisted or rotated relative to each other generally about a twist axis which extends from the front area to the rear area. Under such circumstance, a modulus of elasticity of the center section should be smaller to facilitate twisting the twistable one piece skateboard, and a modulus of elasticity of the front/rear area should be larger to provide adequate support. However, the conventional twistable one piece skateboard is of one piece such that the center section and the front/rear area are the same material with the same modulus of elasticity. Additionally, the front/rear area is wider than the center section for enhancing the stiffness thereof. Nevertheless, it results in a shortcoming of heavy weight.

The present invention is, therefore, intended to obviate or at least alleviate the problems encountered in the prior art.

SUMMARY OF THE INVENTION

According to the present invention, the main purpose is to provide a skateboard comprising a frame and a pedal. The frame has two opposing ends including a first end and a second end. The frame further has a connecting portion formed between and connected to the first end and the second end. The first end includes at least one guiding portion formed on one side thereof. A bottom face of the first end is connected to a first wheel, and a bottom face of the second end is connected to a second wheel. The pedal is installed to the first end of the frame and including a coupling portion. The pedal has at least one retaining portion formed on one lateral side of the coupling portion and corresponding to the guiding portion. The retaining portion is slidably disposed to the guiding portion. The frame and the first pedal are separately manufactured.

An advantage of the skateboard according to the present invention is that the frame, and the first and second pedals are separately manufactured such that the size of the mold is reduced. Thus, the skateboard can be made at low costs and is easy to assemble.

Another advantage of the skateboard according to the present invention is that the frame is more flexible than the first or second pedal so that the connecting portion is more easily twisted.

Another advantage of the skateboard according to the present invention is that the first/second pedals have enough stiffness to provide adequate support to prevent the deformation thereof.

A further advantage of the skateboard according to the present invention is that the skateboard is able to adjust the size thereof by moving the first pedal or the second pedal.

Other advantages and features of the present invention will become apparent from the following description referring to the drawings.

BRIEF DESCRIPTION OF THE DRAWINGS

The present invention will be described through detailed illustration of the preferred embodiments referring to the drawings.

DETAILED DESCRIPTION OF THE PREFERRED EMBODIMENTS

Figure 1:
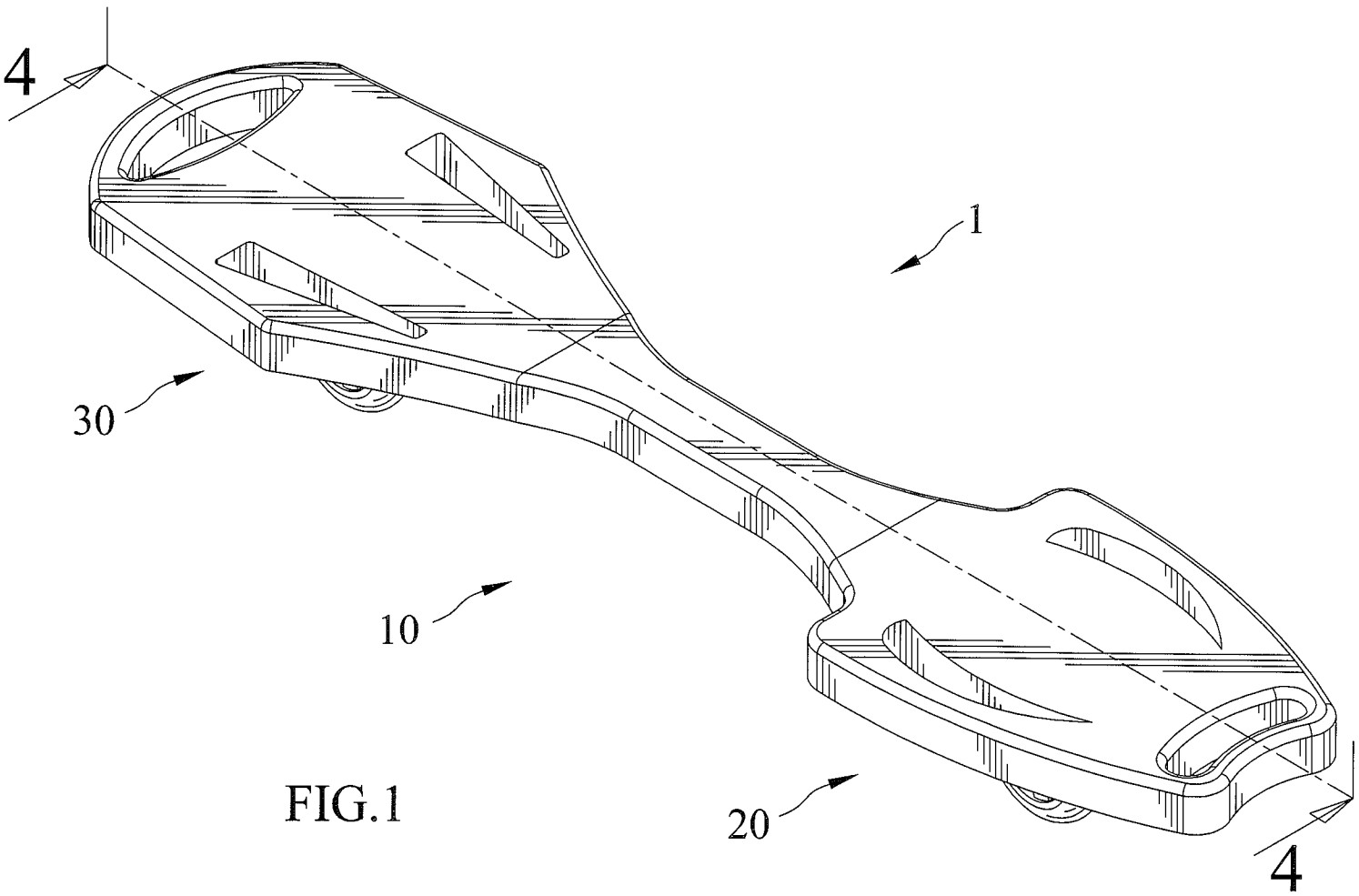
FIG. 1 is a perspective view of a skateboard according to the present invention.
Figure 2:
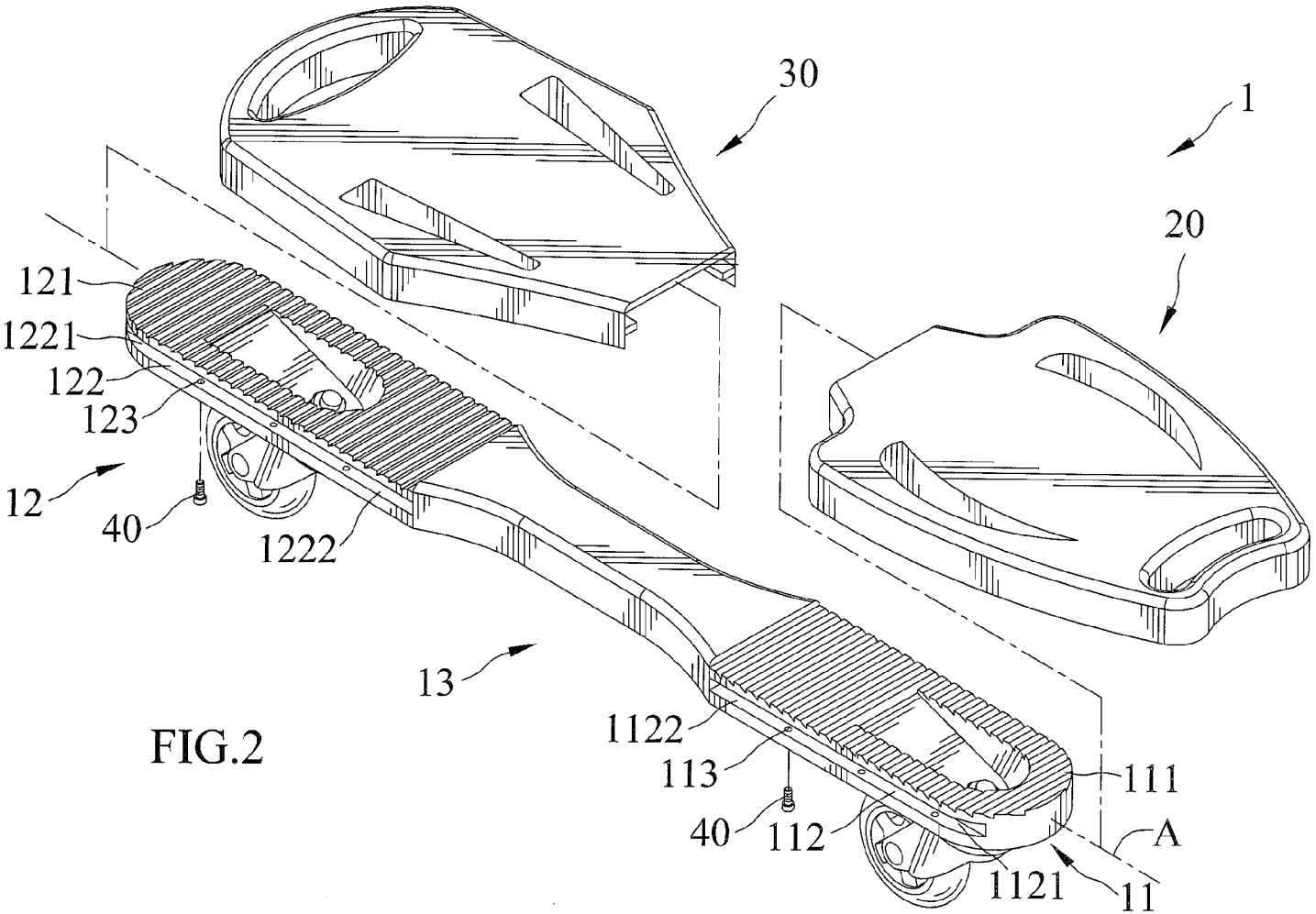
FIG. 2 is an exploded perspective view of the skateboard of FIG. 1.
Figure 3:
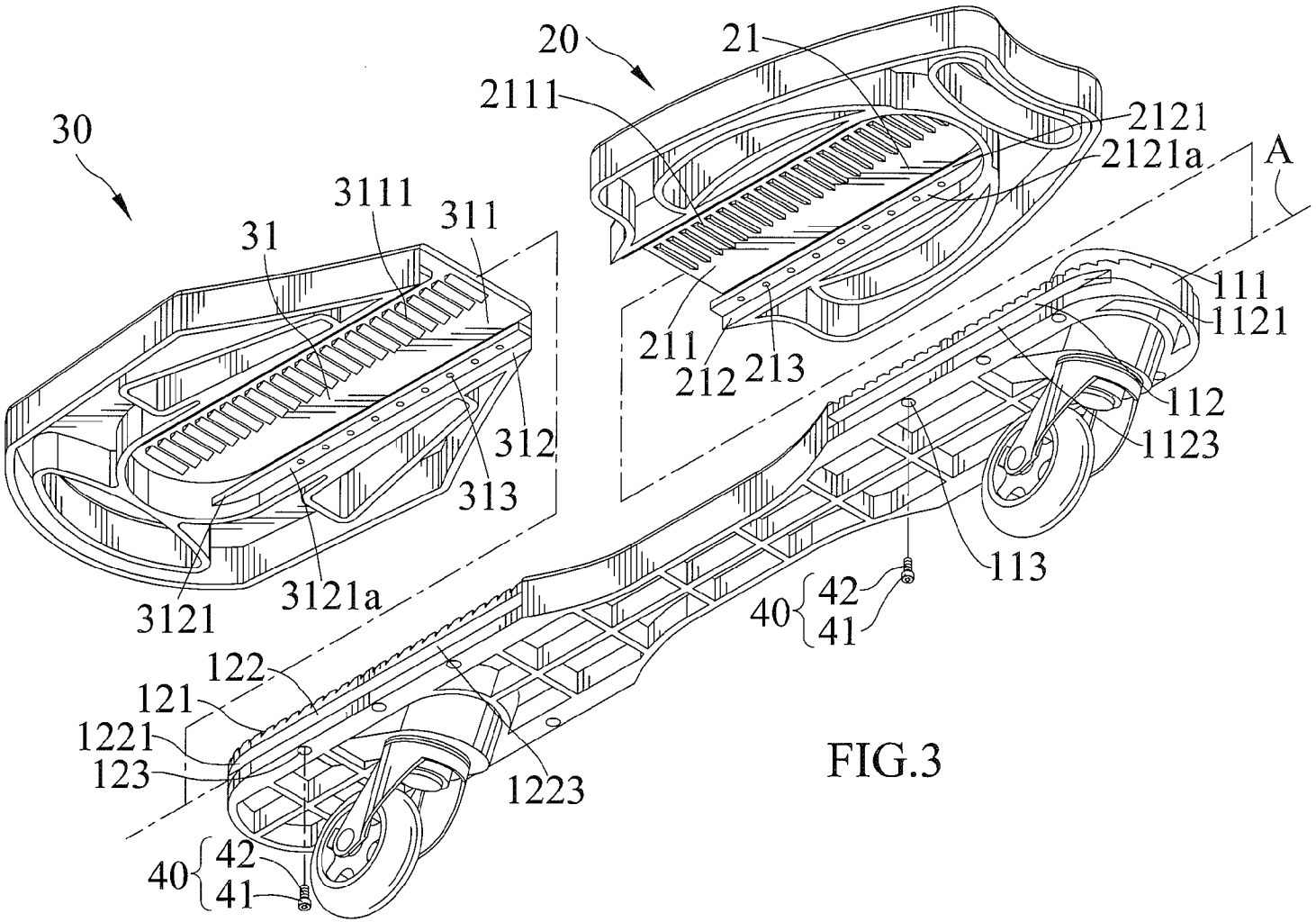
FIG. 3 is an exploded perspective view of the skateboard taken from a different angle than that of FIG. 2.
Figure 4:
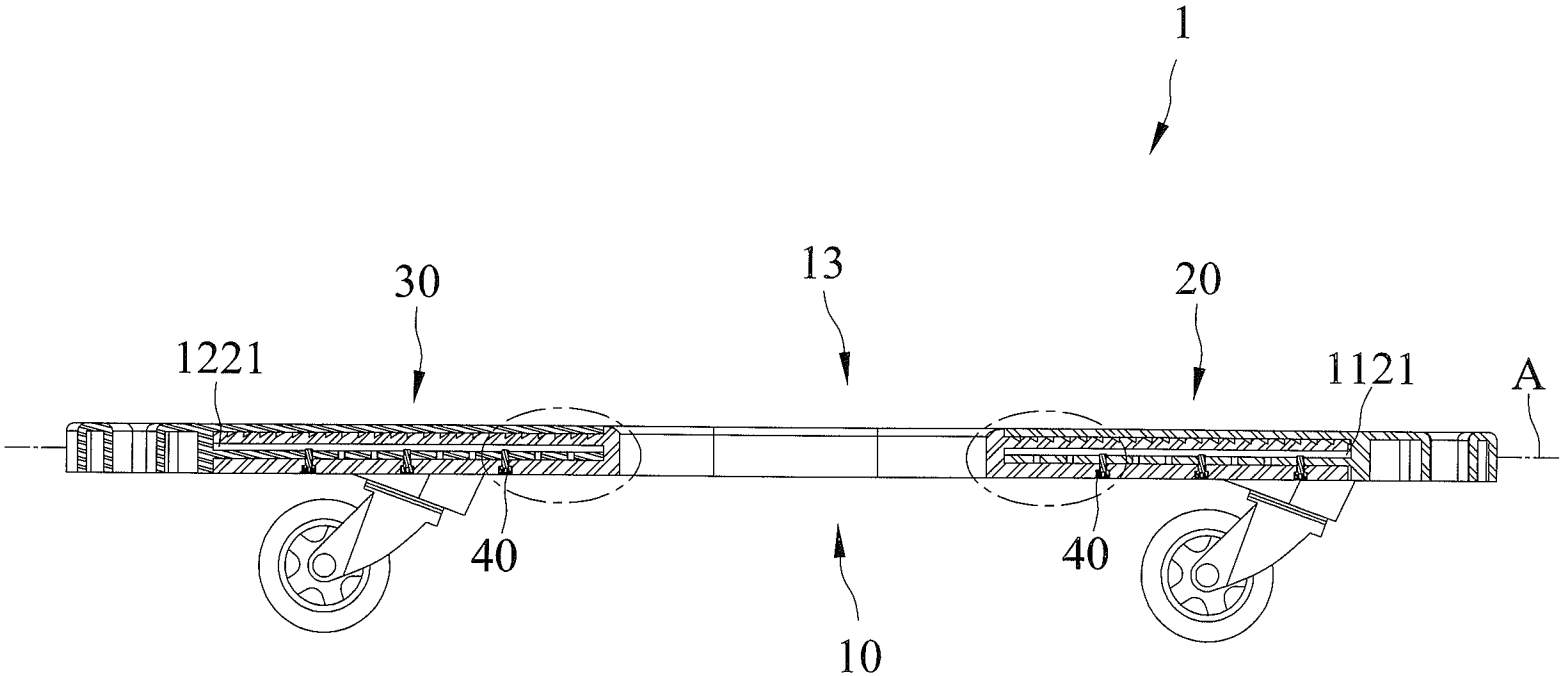
FIG. 4 is a cross-section view taken along line 4-4 of FIG. 1.
Figure 5:
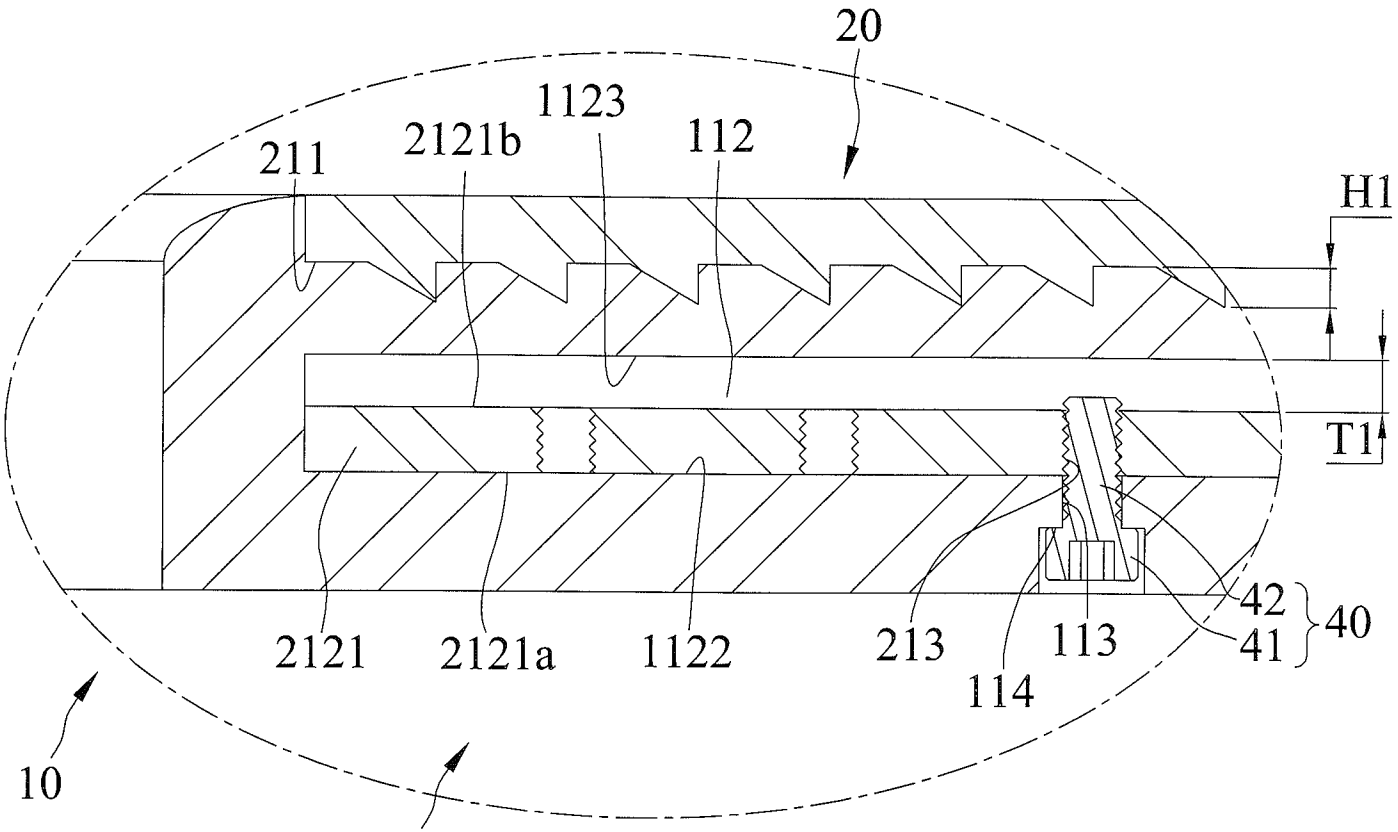
FIG. 5 is a partial, enlarged view of FIG. 4.
Figure 6:
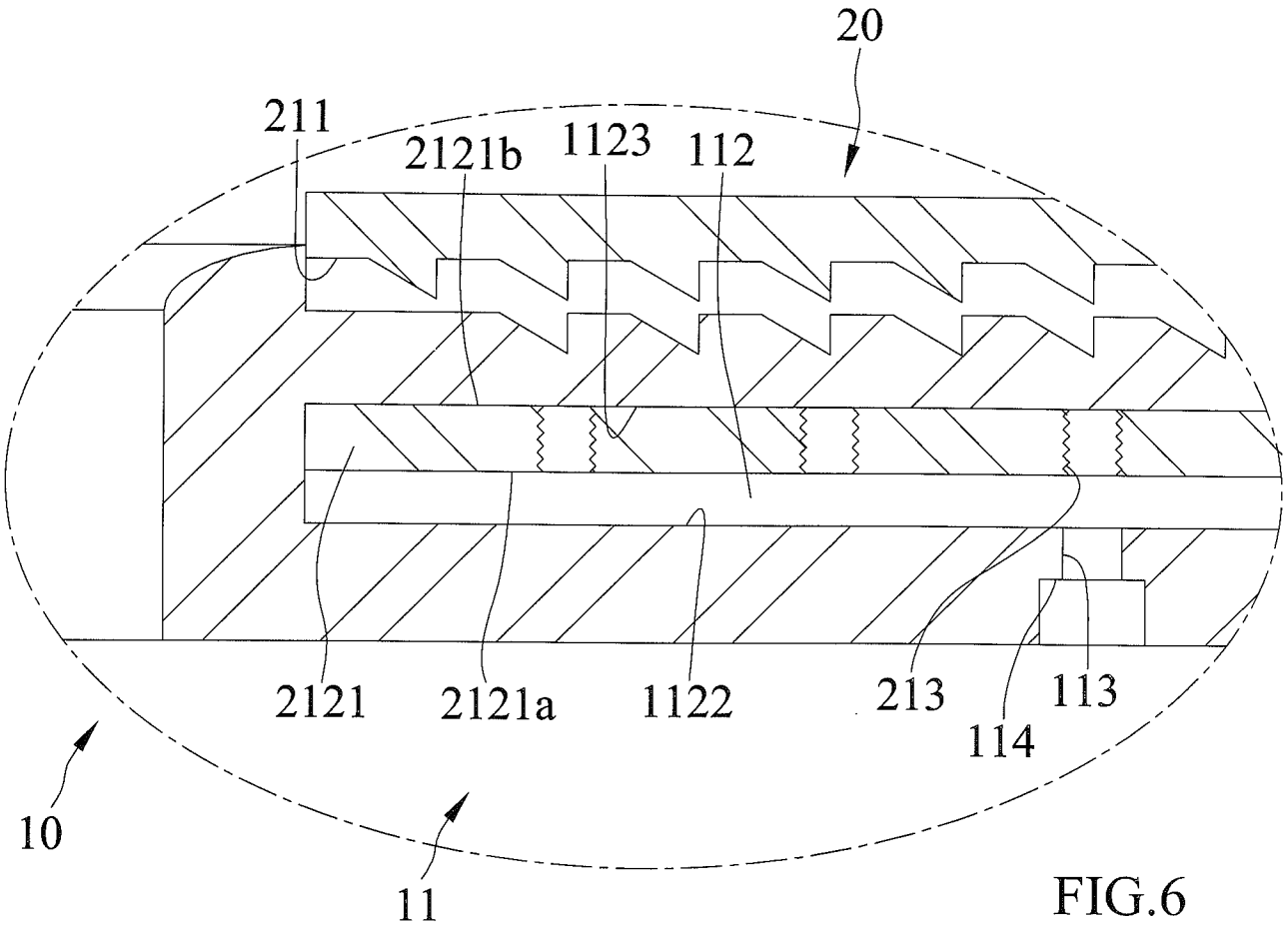
FIG. 6 is a continued cross-section view of FIG. 5 and shows a first pedal able to move with respect to a first end of a frame.
Figure 7:
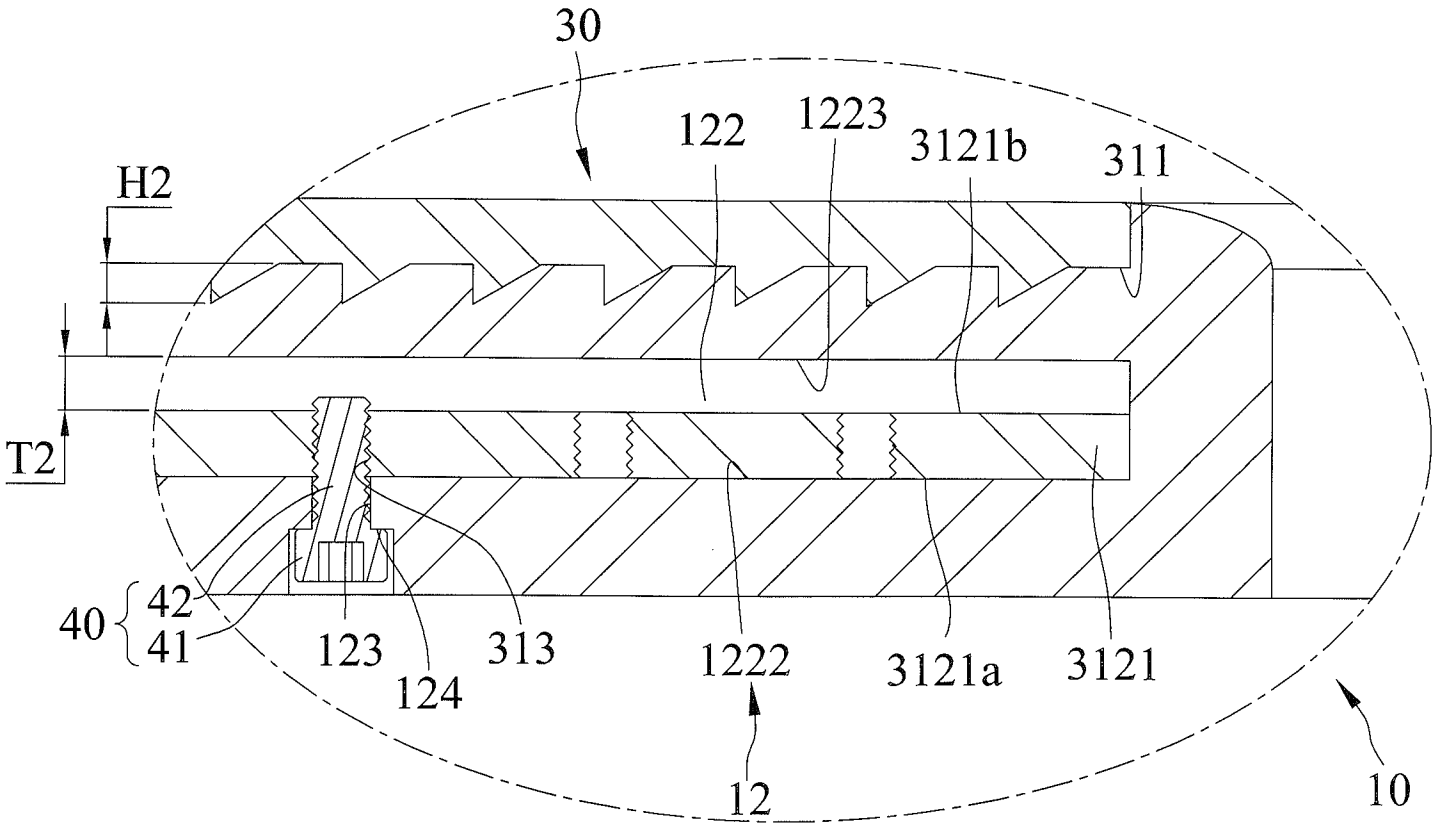
FIG. 7 is a partial, enlarged view of FIG. 4.
Figure 8:
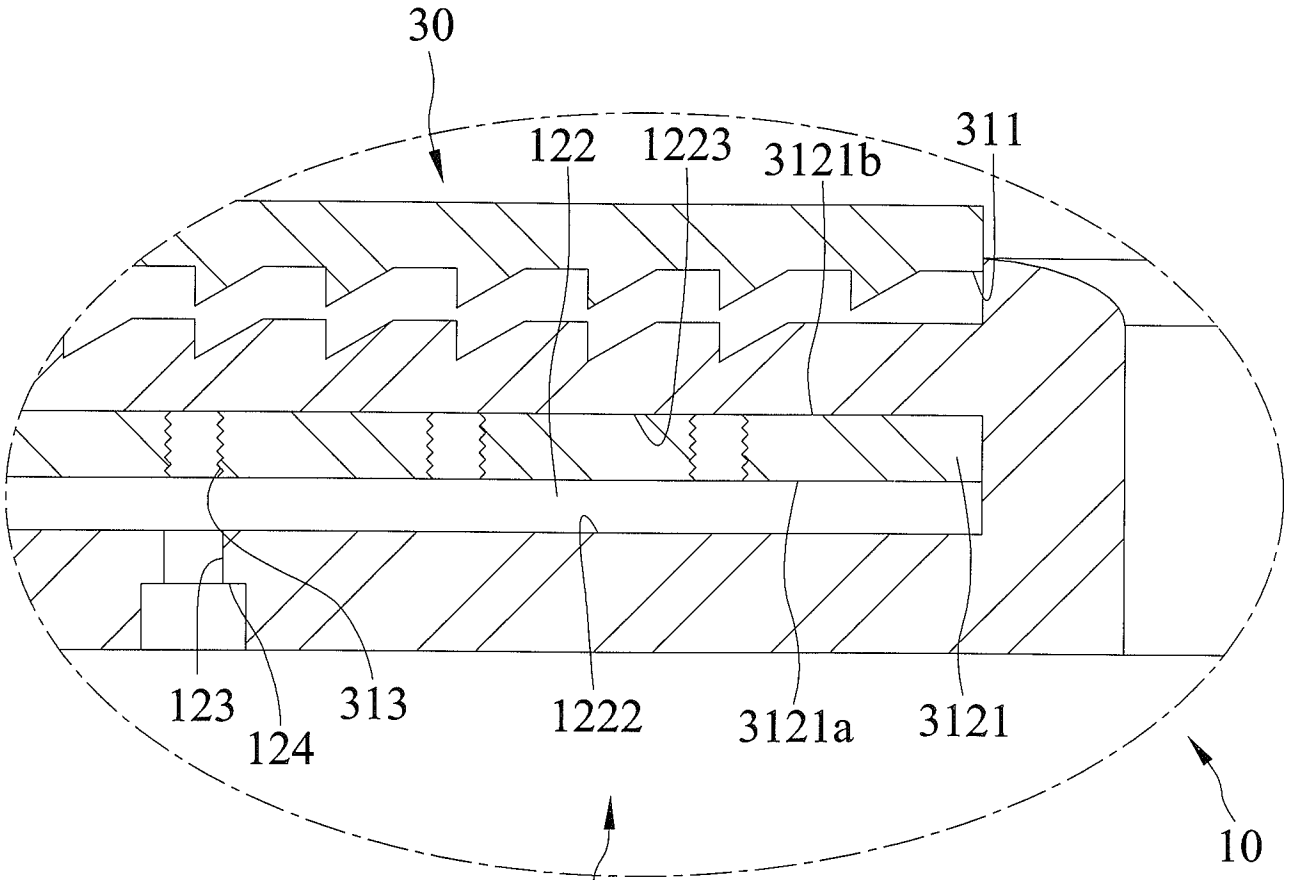
FIG. 8 is a continued cross-section view of FIG. 7 and shows a second pedal able to move with respect to a second end of the frame.
Figure 9:
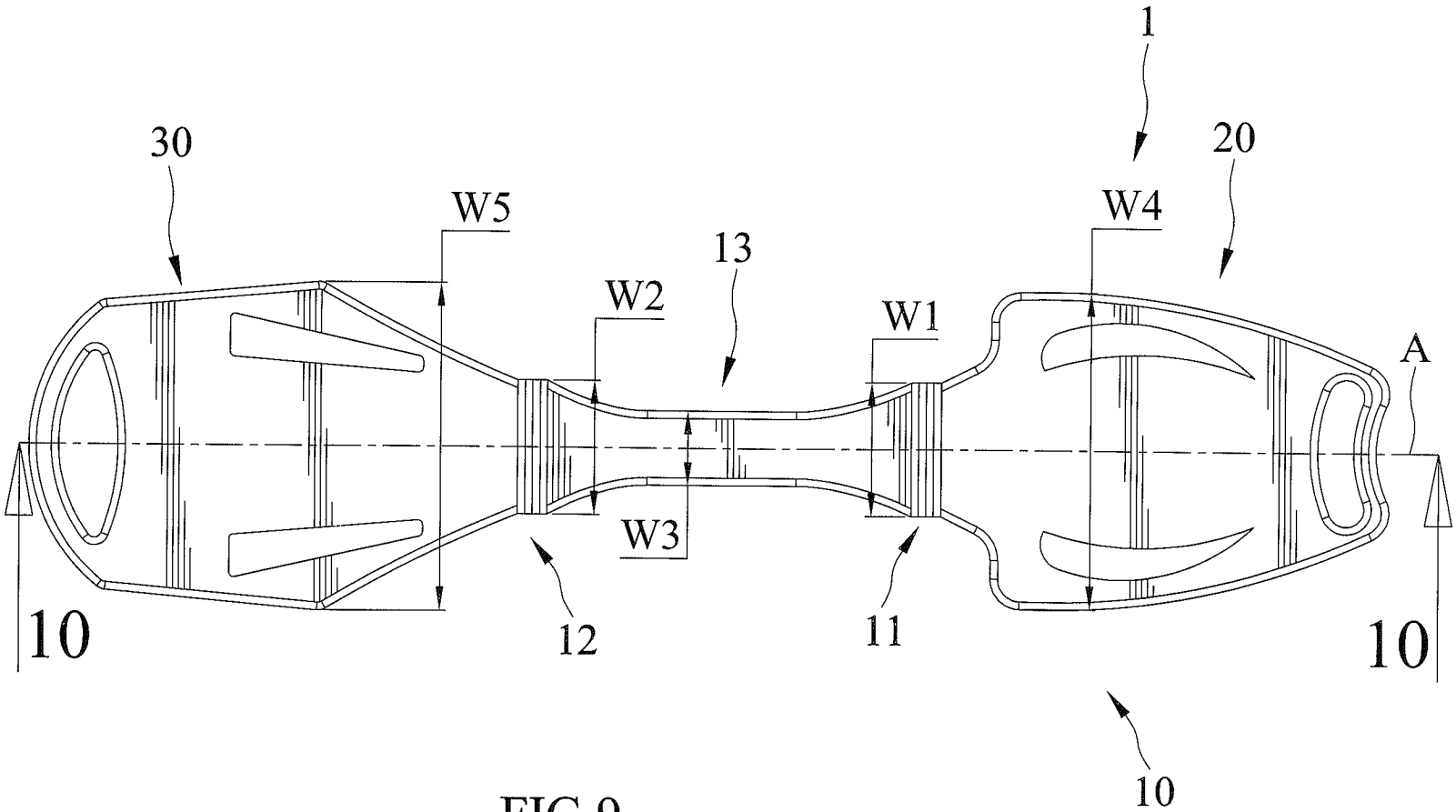
FIG. 9 shows the skateboard according to the present invention able to be adjusted the size thereof.
Figure 10:
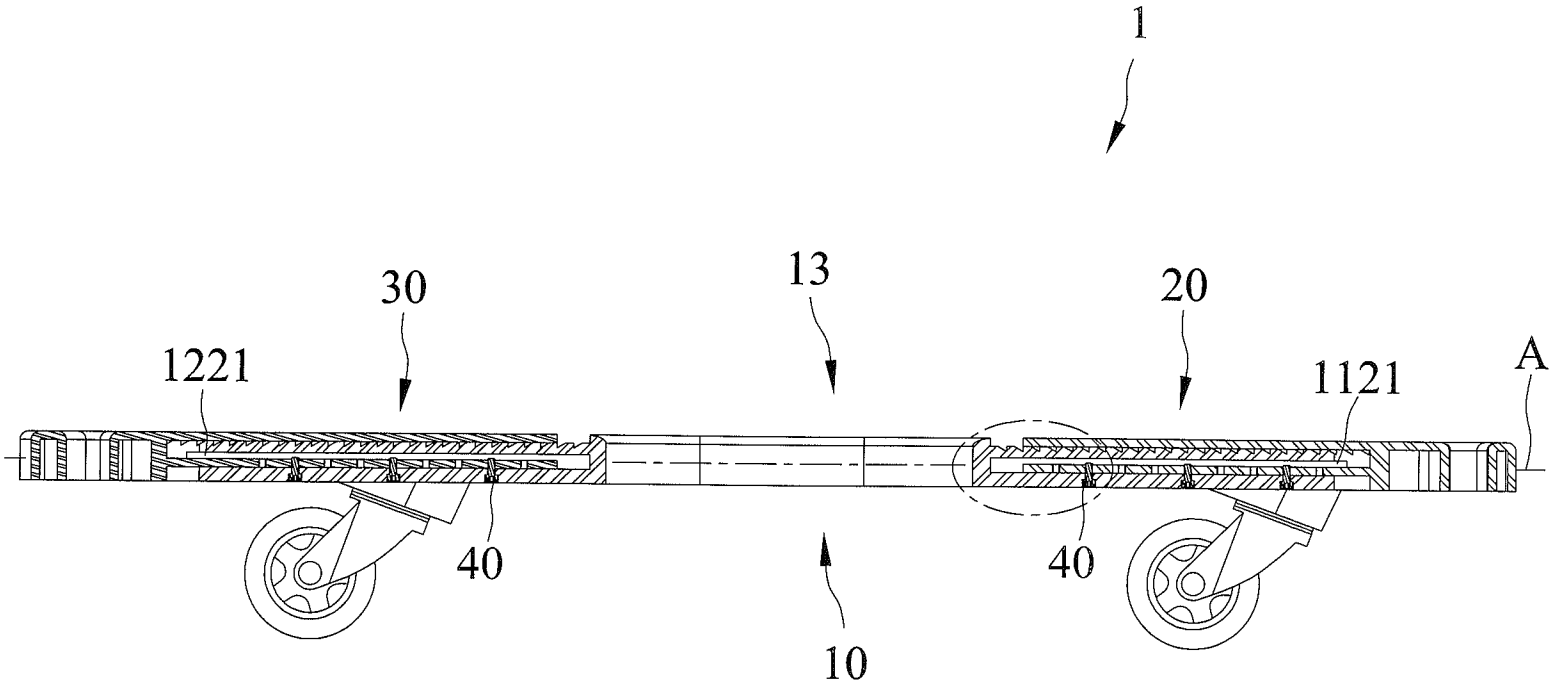
FIG. 10 is a cross-section view taken along line 10-10 of FIG. 9.
Figure 11:
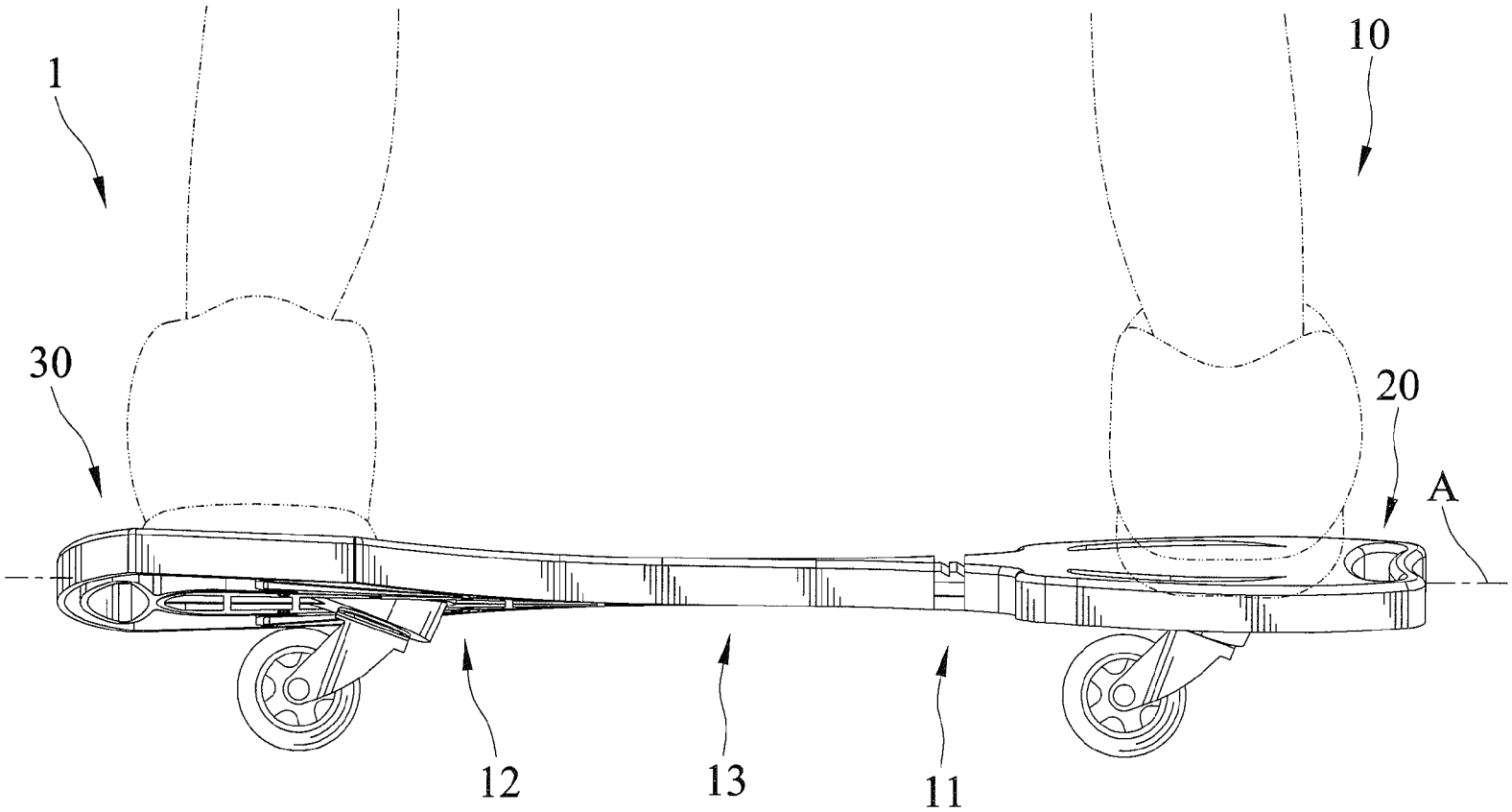
FIG. 11 shows the skateboard according to the present invention operated by twisting the first pedal and the second pedal with respect to each other to control the locomotion thereof.

Referring to FIGS. 1 through 11, there is shown a skateboard 1 according to the present invention, the skateboard 1 comprises a frame 10, a first pedal 20, a second pedal 30, and a plurality of fasteners 40. The first and second pedals 20 and 30 are installed to the frame 10 by the fasteners 40.

The frame 10 has two opposing ends including a first end 11 and a second end 12. The frame 10 further has a connecting portion 13 formed between and connected to the first end 11 and the second end 12. Preferably, the first and second ends 11 and 12 and the connecting portion 13 are integrally formed as a single piece, and the first and second ends 11 and 12 of the frame 10 are able to be twisted with respect to each other about an axis A of the frame 10.

The first end 11 has a top face, a bottom face parallel to and spaced from the top face, and two sides extending from the top face to the bottom face parallel to and spaced from each other. The first end 11 includes an adjusted portion 111 formed on the top face thereof, and at least one guiding portion 112 formed on one of the two sides thereof. The adjusted portion 111 has a plurality of teeth formed thereon. Each tooth is asymmetric, or the two sides of each tooth are not equal. Preferably, each tooth extends substantially toward the second end 12. Preferably, the first end 11 includes two guiding portions 112 formed on the two sides, respectively, and each guiding portion 112 is in the form of a groove. Each guiding portion 112 extends parallel to the axis A and has an opening 1121 formed on one end thereof distal from the second end 12. The first end 11 further includes a plurality of apertures 113 extending from the bottom face thereof to a lower face 1122 of the guiding portion 112. The plurality of apertures 113 is evenly distributed on the guiding portion 112 and along the axis A. The plurality of apertures 113 is adapted for insertion of the fasteners 40. The bottom face of the first end 11 is connected to a first wheel (not labeled).

The second end 12 has a top face, a bottom face parallel to and spaced from the top face, and two sides extending from the top face to the bottom face parallel to and spaced from each other. The second end 12 includes an adjusted portion 121 formed on the top face thereof, and at least one guiding portion 122 formed on one of the two sides thereof. The adjusted portion 121 has a plurality of teeth formed thereon. Each tooth is asymmetric, or the two sides of each tooth are not equal. Preferably, each tooth extends substantially toward the first end 11. Preferably, the second end 12 includes two guiding portions 122 formed on the two sides, respectively, and each guiding portion 122 is in the form of a groove. Each guiding portion 122 extends parallel to the axis A and has an opening 1221 formed on one end thereof distal from the first end 11. The second end 12 further includes a plurality of apertures 123 extending from the bottom face thereof to a lower face 1222 of the guiding portion 122. The plurality of apertures 123 is evenly distributed on the guiding portion 122 and along the axis A. The plurality of apertures 123 is adapted for insertion of the fasteners 40. The bottom face of the second end 12 is connected to a second wheel (not labeled).

The first pedal 20 is installed to the first end 11 of the frame 10 and includes a coupling portion 21 formed on a bottom side thereof. Preferably, the coupling portion 21 is in the form of a recess and includes a connecting face 211 and two lateral sides 212 extending from the connecting face 211 parallel to and spaced from each other. The connecting face 211 has an engaging section 2111 formed thereon and corresponding to the adjusted portion 111. Additionally, the engaging section 2111 has a plurality of teeth formed thereon. Each tooth is asymmetric, or the two sides of each tooth are not equal. Preferably, each tooth extends substantially distal from the second end 12. The engaging section 2111 is adapted to be engaged with the adjusted portion 111 to prevent the first pedal 20 from detaching from the first end 11 of the frame 10. The first pedal 20 has at least one retaining portion 2121 formed on one of the two lateral sides 212 thereof and corresponding to the guiding portion 112. Preferably, the first pedal 20 has two retaining portions 2121 formed on the two sides, respectively, and each retaining portion 2121 is in the form of a flange and extends along the axis A. The retaining portion 2121 is slidably disposed to the guiding portion 112. The retaining portion 2121 of the first pedal 20 includes a plurality of positioning holes 213 extending from a first face 2121*a* thereof to a second face 2121*b* thereof, and corresponding to the plurality of apertures 113, respectively. Preferably, each positioning hole 213 is in the form of a screw hole and is adapted for installation of the fasteners 40.

The second pedal 30 is installed to the second end 12 of the frame 10 and includes a coupling portion 31 formed on a bottom side thereof. Preferably, the coupling portion 31 is in the form of a recess and includes a connecting face 311 and two lateral sides 312 extending from the connecting face 311 parallel to and spaced from each other. The connecting face 311 has an engaging section 3111 formed thereon and corresponding to the adjusted portion 121. Additionally, the engaging section 3111 has a plurality of teeth formed thereon. Each, in tooth is asymmetric, or the two sides of each tooth are not equal. Preferably, each tooth extends substantially distal from the first end 11. The engaging section 3111 is adapted to be engaged with the adjusted portion 121 to prevent the second pedal 30 from detaching from the second end 12 of the frame 10. The second pedal 30 has at least one retaining portion 3121 formed on one of the two lateral sides 312 thereof and corresponding to the guiding portion 122. Preferably, the second pedal 30 has two retaining portions 3121 formed on the two sides, respectively, and each retaining portion 3121 is in the form of a flange and extends parallel to the axis A. The retaining portion 3121 is slidably disposed to the guiding portion 122. The retaining portion 3121 of the second pedal 30 includes a plurality of positioning holes 313 extending from a first face 3121*a* thereof to a second face 3121*b* thereof, and corresponding to the plurality of apertures 123, respectively. Preferably, each positioning hole 313 is in the form of a screw hole for installation of the fastener 40.

In a preferred form, each fastener 40 is in the form of a screw and has a head portion 41 adapted for abutting the first end 11 or the second end 12, and a fixing portion 42. The fixing portion 42 of each fastener 40 corresponds to and installed to the positioning hole 213 or 313 to prevent the first pedal 20 or the second pedal 30 from detaching from the frame 10.

The retaining portion 2121 of the first pedal 20 is installed to the guiding portion 112 of the first end 11 via the opening 1121 of the first end 11, and the first face 2121*a* abuts the lower face 1122 of the guiding portion 112 of the first end 11. Preferably, the second face 2121*b* of the retaining portion 2121 and an upper face 1123 of the first end 11 have a first distance T1 therebetween, and the top face of the first end 11 and the connecting face 211 of the first pedal 20 have a first height H1 therebetween, i.e., a height of the teeth of the engaging section 2111. Preferably, the first distance T1 is larger than the first height H1 such that the engaging section 2111 of the first pedal 20 is able to be disengaged from the adjusted portion 111 of the frame 10 to move the first pedal 20 along the axis A. Once the first pedal 20 is moved to an accepted position, a user can press the first pedal 20, but not necessarily, to re-engage the engaging section 2111 with the adjusted portion 111 to prevent the first pedal 20 from sliding with respect to the frame 10. The first face 2121*a* abuts the lower face 1122 and one of the fasteners 40 is installed to the corresponding positioning hole 213 and aperture 113. The head portion 41 of the fastener 40 is engaged with a slot 114 of the first end 11 which is in communication with the corresponding aperture 113, and the fixing portion 42 of the fastener 40 is secured to the corresponding positioning hole 213. The first pedal 20 is steadily installed to the first end 11 of the frame 10.

The retaining portion 3121 of the second pedal 30 is installed to the guiding portion 122 of the second end 12 via the opening 1221 of the second end 12, and the first face 3121*a* abuts a lower face 1222 of the guiding portion 122 of the second end 12. Preferably, the second face 3121*b* of the retaining portion 3121 and an upper face 1223 of the second end 12 have a second distance T2 therebetween, and the top face of the second end 12 and the connecting face 311 of the second pedal 30 have a second height H2 therebetween, i.e., a height of the teeth of the engaging section 3111. Preferably, the second distance T2 is larger than the second height H2 such that the engaging section 3111 of the second pedal 30 is able to be disengaged from the adjusted portion 121 of the frame 10 to move the second pedal 30 along the axis A. Once the second pedal 30 is moved to an accepted position, the user can press the second pedal 30, but not necessarily, to re-engage the engaging section 3111 with the adjusted portion 121 to prevent the second pedal 30 from sliding with respect to the frame 10. The first face 3121*a* abuts the lower face 1222 and one of the fasteners 40 is installed to the corresponding positioning hole 313 and aperture 123. The head portion 41 of the fastener 40 is engaged with a slot 124 of the second end 12 which is in communication with the corresponding aperture 123, and the fixing portion 42 of the fastener 40 is secured to the corresponding positioning hole 313. The second pedal 30 is steadily installed to the second end 12 of the frame 10. Therefore, the skateboard 1 is able to adjust the size thereof by moving the first pedal 20 or the second pedal 30. Further, the frame 10, and the first and second pedals 20 and 30 are separately manufactured such that the size of the mold is reduced. Thus, the skateboard 1 according to the preferred teaching of the present invention can be made at low costs and is easy to assemble.

In operation, the skateboard 1 can be operated by twisting the first pedal 20 and the second pedal 30 with respect to each other about the axis A to control the locomotion thereof.

The frame 10 has a width direction perpendicular to the axis A and perpendicular to a thickness direction thereof. The first end 11 has a first width W1 along the width direction and defining a maximum width thereof. The second end 12 has a second width W2 along the width direction and defining a maximum width thereof. The connecting portion has a third width W3 along the width direction and defining a minimum width thereof. Preferably, the third width W3 is smaller than the first or second width W1 and W2 to facilitate the connecting portion 13 being twisted in alternating directions by the user. The first pedal 20 has a fourth width W4 along the width direction and defining a maximum width thereof. The second pedal 30 has a fifth width W5 along the width direction and defining a maximum width thereof. Preferably, the first width W1 is smaller than the fourth width W4, and the second width W2 is smaller than the fifth width W5 so that the volume of the frame 10 and the cost are reduced.

In the preferred form, a modulus of elasticity of the frame 10 is smaller than a modulus of elasticity of the first or of the second pedal 20 and 30. The frame 10 is more flexible than the first or second pedal 20 and 30 so that the connecting portion 13 is more easily twisted. On the other hand, the first/second pedals 20 and 30 have enough stiffness to provide adequate support, and prevent the deformation thereof.

The present invention has been described through the illustration of the embodiments. Those skilled in the art can derive variations from the embodiments without departing from the scope of the present invention. Hence, the embodiments shall not limit the scope of the present invention defined in the claims.

What is claimed is:

1. A skateboard comprising:

a frame having two opposing ends including a first end and a second end, wherein the frame further has a connecting portion formed between and connected to the first end and the second end, wherein the first end includes at least one guiding portion formed on one side thereof, with a bottom face of the first end connected to a first wheel, with a bottom face of the second end connected to a second wheel; and a first pedal installed to the first end of the frame and including a coupling portion, wherein the first pedal has at least one retaining portion formed on one lateral side of the coupling portion and corresponding to the guiding portion, with the retaining portion slidably disposed to the guiding portion, wherein the frame and the first pedal are separately manufactured;

wherein the first end includes an adjusted portion formed on a top face thereof, wherein the adjusted portion has a plurality of teeth formed thereon, wherein the coupling portion includes a connecting face, wherein the connecting face has an engaging section formed thereon and corresponding to the adjusted portion, wherein the engaging section has a plurality of teeth formed thereon, wherein the engaging section is engaged with the adjusted portion.

2. The skateboard as claimed in claim 1, wherein the frame includes an axis about which the first and second ends of the frame are twisted, with the guiding portion extending parallel to the axis, and with the retaining portion extending parallel to the axis.

3. The skateboard as claimed in claim 1 further comprising a plurality of fasteners installed between the first pedal and the first end of the frame.

4. The skateboard as claimed in claim 3, wherein the first end further includes a plurality of apertures extending from the bottom face thereof to a lower face of the guiding portion for insertion of the plurality of fasteners.

5. The skateboard as claimed in claim 4, wherein the retaining portion of the first pedal includes a plurality of positioning holes extending from a first face thereof to a second face thereof, and corresponding to the plurality of apertures, respectively.

6. The skateboard as claimed in claim 5, wherein each fastener has a head portion abutting the first end and a fixing portion corresponding to and installed to the positioning hole.

7. The skateboard as claimed in claim 1, wherein each tooth is asymmetric and extends substantially toward the second end.

8. The skateboard as claimed in claim 1, wherein while a first face of the retaining portion of the first pedal abuts a lower face of the guiding portion of the first end, the second face of the retaining section and an upper face of the first end have a first distance therebetween, wherein a top face of the first end and the connecting face have a first height therebetween, with the first distance is larger than the first height.

9. The skateboard as claimed in claim 1 further comprising a second pedal, wherein the second end includes at least one guiding portion formed on one side thereof, with the second pedal installed to the second end of the frame and including a coupling portion, wherein the second pedal has at least one retaining portion formed on one lateral side of the coupling portion of the second pedal and corresponding to the guiding portion of the second end.

10. The skateboard as claimed in claim 9 further comprising a plurality of fasteners installed between the first and second pedals and the first and second ends of the frame.

11. The skateboard as claimed in claim 10, wherein the first end further includes a plurality of apertures extending from the bottom face thereof to a lower face of the guiding portion thereof for insertion of the plurality of fasteners, wherein the retaining section of the first pedal includes a plurality of positioning holes extending from a first face thereof to a second face thereof, and corresponding to the plurality of apertures of the first end, respectively, wherein the second end further includes a plurality of apertures extending from the bottom face thereof to a lower face of the guiding portion thereof and adapted for insertion of the fasteners, wherein the retaining section of the second pedal includes a plurality of positioning holes extending from a first face thereof to a second face thereof, and corresponding to the plurality of apertures of the first end, respectively.

12. A skateboard comprising:

a frame having two opposing ends including a first end and a second end, wherein the frame further has a connecting portion formed between and connected to the first end and the second end, wherein the first end includes at least one guiding portion formed on one side thereof, with a bottom face of the first end connected to a first wheel, with a bottom face of the second end connected to a second wheel;

a first pedal installed to the first end of the frame and including a coupling portion, wherein the first pedal has at least one retaining portion formed on one lateral side of the coupling portion and corresponding to the guiding portion, with the retaining portion slidably disposed to the guiding portion, wherein the frame and the first pedal are separately manufactured; and a second pedal, wherein the second end includes at least one guiding portion formed on one side thereof, with the second pedal installed to the second end of the frame and including a coupling portion, wherein the second pedal has at least one retaining portion formed on one lateral side of the coupling portion of the second pedal and corresponding to the guiding portion of the second end;

wherein the first end includes an adjusted portion formed on a top face thereof, wherein the adjusted portion of the first end has a plurality of teeth formed thereon, wherein the coupling portion of the first pedal includes a connecting face, wherein the connecting face of the first pedal has an engaging section formed thereon and corresponding to the adjusted portion of the first end, wherein the engaging section of the first pedal has a plurality of teeth formed thereon, wherein the engaging section of the first pedal is engaged with the adjusted portion of the first end, wherein the second end includes an adjusted portion formed on a top face thereof, wherein the adjusted portion of the second end has a plurality of teeth formed thereon, wherein the coupling portion of the second pedal includes a connecting face, wherein the connecting face of the second pedal has an engaging section formed thereon and corresponding to the adjusted portion of the second end, wherein the engaging section of the second pedal has a plurality of teeth formed thereon, wherein the engaging section of the second pedal is engaged with the adjusted portion of the second end.

13. The skateboard as claimed in claim 12, wherein a modulus of elasticity of the frame is smaller than a modulus of elasticity of the first pedal or of the second pedal.

* * * * *